US012650122B2

(12) United States Patent
Metzler et al.

(10) Patent No.: US 12,650,122 B2
(45) Date of Patent: Jun. 9, 2026

(54) METHOD FOR CONTROLLING THE DELIVERY PRESSURE OF A SUPPLY PUMP

(71) Applicant: Henkel AG & Co. KGaA, Duesseldorf (DE)

(72) Inventors: Mario Metzler, Gotzis (AT); Guenter Baldauf, Hohenweiler (AT); Norbert Ganahl, Rankweil (AT)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 18/815,925

(22) Filed: Aug. 27, 2024

(65) Prior Publication Data

US 2024/0418160 A1 Dec. 19, 2024

Related U.S. Application Data

(63) Continuation of application No. PCT/EP2023/055322, filed on Mar. 2, 2023.

(51) Int. Cl.
*F04B 49/08* (2006.01)
*F04B 13/00* (2006.01)
*F04B 15/02* (2006.01)

(52) U.S. Cl.
CPC ..... *F04B 49/08* (2013.01); *F04B 13/00* (2013.01); *F04B 15/02* (2013.01)

(58) Field of Classification Search
CPC ..... F04B 23/04; F04B 13/00; F04B 49/08
See application file for complete search history.

(56) References Cited

U.S. PATENT DOCUMENTS 4,881,820 A * 11/1989 Luckhoff ..... B01F 35/8822 366/152.2
10,960,575 B2 3/2021 Baldauf et al.
(Continued)

FOREIGN PATENT DOCUMENTS

DE 102019212385 A1 2/2021
EP 1079170 A1 * 2/2001 ..... F04B 11/0016
(Continued)

OTHER PUBLICATIONS

International Search Report for International Patent Application No. PCT/EP2023/055322—Mailing date: Apr. 17, 2023.

*Primary Examiner* — Jessica Cahill
(74) *Attorney, Agent, or Firm* — Mary K. Cameron

(57) ABSTRACT

Methods for controlling supply pump delivery pressure in a system having a supply pump, a metering pump, a delivery line extending between them where the supply pump delivers material through the delivery line to a metering pump inlet; and a pretensioned pressure buffer of variable buffer volume is connected upstream of the metering pump inlet, the buffer volume capable of receiving material from the delivery line when delivery line pressure near the pressure buffer is > pretensioning pressure P of the pressure buffer and capable of dispensing material to the delivery line when delivery line pressure near the pressure buffer is < the pretensioning pressure P; the system may also include a pressure sensor and a control unit, connected to the sensor, supply pump, and metering pump, which transmits a value to the supply pump based on metering pump status and delivery line actual pressure deviation from target pressure.

8 Claims, 1 Drawing Sheet

(56) References Cited

U.S. PATENT DOCUMENTS

| | | | | |
|---|---|---|---|---|
| 2002/0189688 | A1* | 12/2002 | Roorda | F16F 1/027 137/529 |
| 2011/0110807 | A1* | 5/2011 | Kobayashi | F04B 11/0008 417/540 |
| 2020/0282393 | A1* | 9/2020 | Cambron | B01L 3/502738 |

FOREIGN PATENT DOCUMENTS

| | | | | |
|---|---|---|---|---|
| EP | 2677313 | A1 | 12/2013 | |
| EP | 2722575 | A1 | 4/2014 | |
| GB | 2103841 | A * | 2/1983 | F04B 49/08 |
| WO | WO-9608648 | A1 * | 3/1996 | F04B 49/065 |
| WO | WO-2010008851 | A1 * | 1/2010 | G01N 30/32 |
| WO | WO-2013062635 | A2 * | 5/2013 | G01N 30/32 |
| WO | 2017004635 | A1 | 1/2017 | |
| WO | WO-2019086671 | A1 * | 5/2019 | F04B 23/06 |

* cited by examiner

METHOD FOR CONTROLLING THE DELIVERY PRESSURE OF A SUPPLY PUMP

BACKGROUND OF THE INVENTION

The invention relates to a method for controlling the delivery pressure of a supply pump in a system for delivering and metering a viscous material.

When processing viscous materials, the plastic component is usually pumped directly from the container, e.g., from a hobbock, via a delivery line to a metering pump using a supply pump. The supply pump is often located several meters away from the metering pump so that the supply pump must build up a sufficiently high delivery pressure to pump the viscous material from the supply pump to the metering pump. During a metering process, i.e., during operation of the metering pump, a pressure drop occurs in the delivery line due to the material outflow. In order to compensate for this pressure loss, a high delivery pressure built up by the supply pump is required. However, at the same time, this also has the result that, between individual metering processes, as soon as the metering pump stops and the pressure loss in the delivery line is significantly lower, the pressure on the inlet side of the metering pump quickly increases sharply.

Very high supply pressures on the inlet side of the metering pump are a decisive factor in the wear of the metering pump, especially the shaft seal. In addition, excessive pressure fluctuations on the inlet side of the metering pump have a negative effects upon the metering accuracy. Finally, even a supply pressure that is too low for a short period of time can lead to significant problems with metering accuracy, or even to wear of the metering pump.

To remedy this, it is known to use material pressure reducing valves near the metering pump inlet. When using such a valve, the delivery pressure of the supply pump is set to a significantly higher pressure than would actually be necessary to supply the metering pump. The material pressure reducing valve reduces the pressure just before the metering pump to the required metering pump inlet pressure.

However, the use of material pressure reducing valves has several disadvantages. The reducing valves are therefore very susceptible to failure. Even small air bubbles in the valve can lead to a so-called "breakthrough" of the pressure, and the metering pump can be damaged or even destroyed by the briefly very high inlet pressure. In addition, material pressure reducing valves are not suitable when processing materials with large or abrasive filler particles, since the particles cause rapid and strong wear of the mechanical components of the valves, and thereby impair their reliability. Finally, material pressure control valves have a relatively high dead weight and a comparatively high price, both of which are considered disadvantageous.

An alternative solution is active pressure control of the supply pump. For this purpose, a pressure sensor is attached to the inlet of the metering pump, which regulates the delivery pressure or the performance of the supply pump via a control circuit according to the pressure detected at the inlet of the metering pump. The disadvantage of this method is the inertia of the system, i.e., the fact that too high or too low a pressure must first be measured at the inlet of the metering pump before the supply pump accordingly reacts. This, in combination with the very rigid delivery lines required due to the high material pressure, regularly leads to an undesirably low or undesirably high pressure on the inlet side of the metering pump when starting and stopping the metering. In addition, scoop piston pumps, which are usually used as supply pumps, do not allow any backflow of material, which makes it impossible to subsequently reduce the pressure during a standstill of the metering pump without causing a leak.

From WO 2017/004635 A1, a device is known with a source for at least one liquid plastic component and one metering device, wherein a buffer device with a variable buffer volume is arranged between the source and the metering device. This makes it possible to make the liquid plastic component available to the metering device without interruption, wherein the pressure prevailing in the liquid plastic component between the buffer device and the metering device can be controlled by the buffer device.

SUMMARY OF THE INVENTION

The present invention has set itself the object of providing a method for controlling the delivery pressure of a supply pump in a system for delivering and metering a viscous material, which can be operated more reliably and with greater accuracy than known methods.

This object is achieved by a method having the features as described herein, see for example the claims. Advantageous embodiments and further developments of the method are the subject matter of the dependent claims.

Disclosed herein is a method for controlling the delivery pressure of a supply pump in a system for delivering and metering a viscous material, wherein the system has a supply pump, a metering pump, and a delivery line which extends between the supply pump and the metering pump, and wherein the supply pump delivers the viscous material from a material store to an inlet of the metering pump through the delivery line using a delivery pressure D, wherein, furthermore, a pressure buffer which is pretensioned to a pretensioning pressure P and has a variable buffer volume is connected upstream of the inlet of the metering pump, wherein the buffer volume can receive viscous material from the delivery line when the delivery pressure in the delivery line in the region of the pressure buffer is higher than the pretensioning pressure P of the pressure buffer, and viscous material can be dispensed into the delivery line from the buffer volume when the delivery pressure in the delivery line in the region of the pressure buffer is lower than the pretensioning pressure P of the pressure buffer, wherein the system additionally has a pressure sensor, connected upstream of the inlet of the metering pump for detecting the actual pressure value in the delivery line, and a control unit, wherein the control unit is connected to the pressure sensor, the supply pump, and the metering pump. The method according to the invention is characterized in that the control unit transmits a specification value to the supply pump, depending upon a deviation between a specified target pressure value and the actual pressure value in the delivery line as well as upon the operating state of the metering pump.

In other words, the method according to the invention provides that a pressure buffer with a variable buffer volume be used upstream of the inlet of the metering pump and pretensioned to a pretensioning pressure P, wherein, in order to mitigate pressure fluctuations in the delivery line, viscous material from the delivery line can be taken up into the buffer volume or discharged from the buffer volume into the delivery line. The pretensioning pressure P changes depending upon the fill level of the buffer volume.

The method according to the invention further provides that not only the actual pressure value detected in the delivery line be used to regulate the delivery pressure of the supply pump, but also information regarding the operating state of the metering pump. In order to determine the specification value for the supply pump, the control unit also processes information about whether the metering pump is starting up and a metering process is starting, or whether the metering pump has been switched off and the metering process is ending. Taking into account the information regarding the operating state of the metering pump enables faster and therefore more precise tracking of the delivery pressure to be built up by the supply pump, since changes in the operating state of the metering pump can be responded to immediately, and there is no need to first wait until the increase or decrease in pressure on the inlet side of the metering pump associated with the change in the operating state is detected by the pressure sensor arranged there. By using a pressure buffer with a variable buffer volume provided according to the invention on the one hand and taking into account the operating state of the metering pump when regulating the delivery pressure of the supply pump on the other, extreme pressure fluctuations on the inlet side of the metering pump and the disadvantages associated therewith can be effectively reduced, and a very constant supply pressure can be set at the inlet of the metering pump.

The control unit preferably comprises a PI (proportional integral) controller or PID (proportional-integral-derivative) controller. This works with the given specified target pressure value and the actual pressure value detected by the pressure sensor on the inlet side of the metering pump. The operating state of the metering pump can be practically considered when regulating the delivery pressure of the supply pump in such a way that the specification value transmitted from the control unit to the supply pump is provided with a correction value, depending upon the operating state of the metering pump. As soon as the metering process is stopped, the value of the I component in a PI or PID control can be multiplied by a factor <1, e.g., by a factor of 0.5, compared to the last value of the I component during the previous metering process. As a result, the specification value transmitted to the supply pump suddenly drops to a significantly lower value when metering is stopped. An expected strong pressure increase on the inlet side of the metering pump due to the changing disturbance variable of "pressure loss in the line" is thus compensated for before a deviation in the measured value detected by the pressure sensor is registered. This means that the delivery pressure can be tracked much faster and more efficiently than would be possible if only the signal from the pressure sensor were to be reacted to, which would only detect a pressure increase on the inlet side of the metering pump a certain time after shutting off the metering pump.

As soon as metering starts again, the value of the I component of the PI or PID control is reset to the last value of the I component during the previous metering process. As a result, the specification value transmitted to the supply pump increases suddenly, and a strong pressure drop on the inlet side of the metering pump upon restarting metering can be prevented. In this way, a relatively constant pressure can be achieved on the inlet side of the metering pump, regardless of the downtime of the metering pump between two meterings.

The use of a pressure buffer within a system for delivering and metering a viscous material has several advantages. In contrast to solutions known from the prior art, when using a pressure buffer, even heavily filled materials and media with abrasive fillers can be easily processed. The method according to the invention is therefore available for a wide variety of applications and can therefore be used very flexibly. The material density of the delivered material can be in a range of about 0.5 to 5 g/cm$^3$, preferably in a range of about 1 to 3 g/cm$^3$. The delivery rate can be about 0.05 cm$^3$/s to 150 cm$^3$/s, preferably about 0.5 cm$^3$/s to 20 cm$^3$/s.

Such pressure buffers also have the advantage of having comparatively small dimensions and weighing significantly less than material pressure reducing valves, such that they can be carried on a robot together with the metering pump, for example.

Finally, the use of a pressure buffer is more cost-effective than the use of a material pressure reducing valve.

The pretensioning force of the pressure buffer causing the pretensioning pressure P can be applied, for example, via a pneumatic force, or a spring force, or a hydraulic force. It is advantageous if the pretensioning force depends upon the fill level of the buffer, i.e., if the pretensioning force is greater the more the buffer volume is filled, in order to avoid unintentional complete filling or emptying of the buffer.

One embodiment of the method according to the invention provides for the use of at least one steel spring, designed as a wave spring, for pretensioning the pressure buffer. Compared to conventional spiral springs, wave springs have a spring height up to 50% lower at the same spring force, and therefore take up significantly less space. This allows for a smaller installation size and a simpler design of the buffer compared to the use of conventional spiral springs.

According to a further embodiment of the invention, the pressure buffer comprises a rolling membrane for hermetically separating the variable buffer volume. This is a highly flexible, thin-walled, fabric-reinforced membrane made of a rubber-elastic material—for example, silicone, polyurethane, fluororubber, ethylene-propylene-diene rubber, or acrylonitrile-butadiene rubber. A rolling membrane has the advantage of an excellent seal, which is particularly important for applications with viscous adhesives. Otherwise, even minuscule leaks would cause adhesive to escape from the buffer volume and harden, and therefore impair the functioning of the buffer or even render it unusable. In addition, a rolling diaphragm enables the buffer to operate with virtually no friction and almost no hysteresis.

According to the invention, the variable buffer volume can comprise a volume of 100 to 10,000 mm$^3$, preferably a volume of 500 to 5,000 mm$^3$. For example, the variable buffer volume can comprise a volume of 1,500 mm$^3$, which is available as compensation volume.

According to an embodiment variant of the method according to the invention, in addition to the signal from the pressure sensor and information regarding the operating state of the metering pump, information regarding the current fill level in the buffer volume can also be included in the control. In this case, the delivery pressure of the supply pump is also adjusted depending upon how much viscous material can be discharged from the buffer volume into the delivery line to compensate for pressure fluctuations, or how much can be taken up from the delivery line by the buffer volume. This allows the control accuracy to be improved even further.

It can be provided that the buffer comprise a plunger which protrudes from a housing of the pressure buffer and via which the fill level of the buffer volume can be determined. In other words, the plunger moves up and down depending upon the fill level of the buffer volume, such that the fill level of the buffer volume can be inferred from the length of the portion of the plunger protruding from the housing of the pressure buffer. This length can be determined optically or with the help of another suitable sensor. The corresponding signal can be fed to the control unit as an additional input signal.

Alternatively, or additionally, when using a means for pretensioning the pressure buffer which is suitable for enabling at least approximately linear spring behavior, the fill level of the buffer volume can also be inferred based upon the measured pressure. In particular, the use of wave springs would be conceivable here, in the case of which the pressure buffer has an almost linear pressure-volume behavior.

According to one embodiment variant of the invention, the pressure sensor and/or a pressure-safeguarding element is accommodated in a housing of the pressure buffer. In other words, the pressure sensor upstream of the inlet of the metering pump can be accommodated directly inside the housing of the pressure buffer and here can detect any pressure fluctuations at an early stage. Additionally or alternatively, a pressure-safeguarding element, such as a bursting disc or a pressure relief valve, can be accommodated in the housing of the pressure buffer so that, in the event of a sudden excessive pressure increase in the delivery line, the pressure can be effectively reduced in order to protect the downstream metering pump.

In one embodiment of the invention, it can be provided that the time-dependent change in the viscosity of the viscous material be taken into account when determining the specification value transmitted to the supply pump. For this purpose, a time-dependent viscosity profile of the viscous material can be stored in the control unit, and this viscosity development over time can be considered, when controlling the supply pump, based upon a PT1 element. In particular, it is possible in this way to influence the pressure at the inlet of the metering pump, the strength or length of a short pressure pulse at the beginning of the next metering, and combinations of the above-mentioned options, depending upon the time that has passed since the last metering.

Alternatively, between two meterings, while the metering pump is standing still, a slightly higher target pressure can be specified at the inlet of the metering pump than is the case during metering. This prevents the pressure at the inlet of the metering pump from briefly falling below a critical threshold when metering is restarted.

When using a scoop piston pump as a supply pump, an undesirable pressure change, such as a pressure drop or a pressure increase in the delivery line, can occur at the switchover point of the pump. According to one embodiment of the invention, a displacement sensor can be provided which detects the position and the speed of the movable piston of the supply pump and transmits information regarding the expected switching point of the supply pump to the control unit for further processing. Thus, by appropriately pre-controlling the air pressure that is applied to a pneumatic supply pump, a major regulation of the pressure drop at the switching point of the supply pump can be achieved. A further advantage of such a displacement sensor is that a leak in the hydraulic system could be reliably detected.

By means of the method according to the invention, a relatively constant pressure of up to 40 bar, preferably 2 to 10 bar, can be set at the inlet of the metering pump when a pressure of up to 300 bar, preferably 10 to 80 bar, is applied by the supply pump. The distance between the supply pump and the metering pump can be about 1 to 20 m, preferably 2 to 10 m.

As a viscous material, in particular a silicone, a polyol, an isocyanate, an MS polymer, a polyacrylate, an epoxy, a butyl, a polysulfide, a dispersion, or a prepolymer of one of the aforementioned groups of substances can be delivered and metered.

Preferably, a viscous material is delivered and metered whose viscosity is in a range of 10,000 mPas to 2,000,000 mPas, preferably in a range of 20,000 mPas to 500,000 mPas.

In the following, the invention is explained in more detail by means of an exemplary embodiment and with reference to the attached drawings.

DETAILED DESCRIPTION

Figure 1:
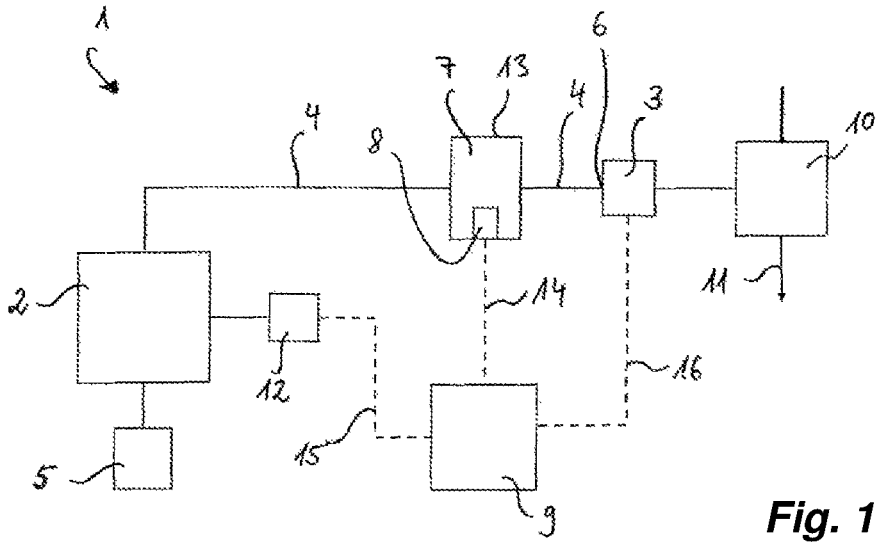
FIG. 1 shows a system for delivering and metering a viscous material as used in the method according to the invention, in a schematic representation.

FIG. 1 shows a schematic representation of a system, designated as a whole by 1, for delivering and metering a viscous material—for example, a plastic component for a sealing material. The system 1 comprises a supply pump 2, designed as a pneumatic scoop piston pump, which pumps the viscous material from a material supply 5 into a delivery line 4. Due to the delivery pressure built up by the supply pump 2, the viscous material is delivered through the delivery line 4 to the inlet 6 of a metering pump 3. The viscous material is discharged to a mixing head 10 via the metering pump 3. In the mixing head 10, the viscous material is mixed with one or more other components, not specified here, before the mixture, indicated by the arrow 11, is discharged from the mixing head 10—for example, in the form of a sealing bead. As an alternative to the mixing head 10 shown here, a component valve (not shown) can also be used if the viscous material is not to be mixed with another component, but instead discharged directly.

The supply pump 2 and the metering pump 3 are controlled via a control unit 9 which includes a PID controller. Since the supply pump 2 is a pneumatic piston pump, the system 1 has a proportional pressure control valve 12, arranged between the control unit 9 and the supply pump 2, which converts an electrical signal from the control unit 9 into a pneumatic pressure that acts upon the supply pump 2.

To detect an actual pressure value in the delivery line 4, the system 1 comprises a pressure sensor 8 which is accommodated in a housing 13 of a pressure buffer 7 and will be described in detail later. The pressure sensor 8 is connected to an input of the control unit 9 via a signal line 14. A given specified target pressure value is stored in the control unit 9, with which the actual pressure value is compared. Depending upon the result of this comparison, a corresponding specification value is transmitted to the supply pump 2 or to the proportional pressure control valve 12 via a signal line 15.

The metering pump 3 is controlled by the control unit 9 via a further signal line 16. In addition to the signal from the pressure sensor, information regarding the operating state of the metering pump 3 is also taken into account by the control unit 9 when determining the specification value for the supply pump 2. In other words, in addition to the pressure value detected by the pressure sensor 8, the control unit 9 also processes information regarding a start or stop of the metering of the metering pump and takes this information into account when determining the specification value transmitted to the supply pump 2. In this way, it is possible to react very quickly to changes in the operating state of the metering pump 3, and a strong increase or decrease in the pressure at the inlet 6 of the metering pump 3 can be prevented. In practice, the operating state of the metering pump 3 is taken into account when regulating the delivery pressure of the supply pump 2 in such a way that the specification value transmitted from the control unit 9 to the supply pump 2 or the proportional pressure control valve 12 is corrected, depending upon the operating state of the metering pump 3. As soon as the metering is stopped, the value of the I component of the PID control is multiplied by a factor of 0.5, compared to the last value of the I component during the previous metering process. As a result, the specification value transmitted to supply pump 2 suddenly drops to a significantly lower value when metering is stopped. As soon as metering starts again, the value of the I component is reset to the last value of the I component during the previous metering process. As a result, the specification value transmitted to the supply pump 2 again increases suddenly, and a strong pressure drop on the inlet side of the metering pump 3 when the metering starts again can be prevented.

In order to influence the pressure in the delivery line 4, in particular at the inlet 6 of the metering pump 3, the system 1 additionally has a pressure buffer 7 connected upstream of the metering pump 3. The pressure buffer 7 comprises a variable buffer volume which can absorb viscous material from the delivery line 4, or from which viscous material can be discharged into the delivery line 4.

Figure 2:
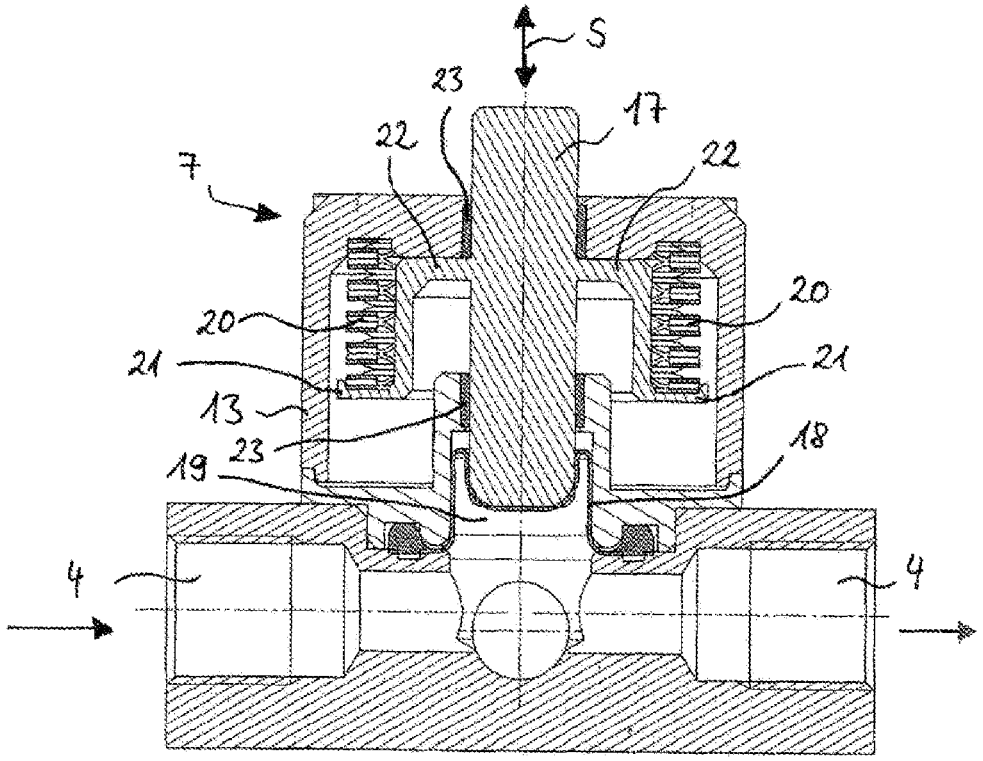
FIG. 2 shows an exemplary embodiment of a pressure buffer which is used in the method according to the invention, in a sectional view.

The structure and functioning of the pressure buffer 7 will be explained in more detail with reference to FIG. 2. The pressure buffer 7 is connected to the delivery line 4, through which viscous material is delivered in the direction indicated by the arrows from the supply pump 2 to the metering pump 3. The pressure buffer 7 comprises a housing 13 and a plunger 17 which is movable in plain bushings 23 in a direction indicated by the arrow S. The plunger 17 protrudes at least partially from the housing 13. At the end, facing the delivery line 4, of the plunger 17, a rolling diaphragm 18 is arranged, by which a variable buffer volume 19 acting as a compensation volume is limited. The buffer volume 19 is hermetically sealed adjacent to the plunger 17 by the rolling diaphragm 18, while it is open adjacent to the delivery line 4 and is in contact therewith. The rolling membrane 18 enables the pressure buffer 7 to operate practically friction-free.

The pressure buffer 7 is pretensioned to a pretensioning pressure P which depends upon the fill level of the buffer volume 19. The pretensioning pressure P is applied by a steel spring, designed as a wave spring 20, which is arranged between a shoulder 21 of the plunger 17 and the inner wall of the housing 13. As soon as the delivery pressure in the delivery line 4 in the region of the pressure buffer 7 and upstream of the metering pump 3 is higher than the pretensioning pressure P of the pressure buffer 7, viscous material from the delivery line 4 enters the buffer volume 19 and presses on the plunger 17 via the rolling diaphragm 18, such that the latter moves upwards away from the delivery line 4, and the wave springs 20 are compressed. The variable buffer volume 19 accordingly increases, and the pretensioning pressure P of the pressure buffer 7 increases. This process continues until a pressure equilibrium is established or until the plunger 17 strikes the housing 13 with its shoulder 22, as FIG. 2 shows. If the delivery pressure in the delivery line 4 drops again below the now prevailing pretensioning pressure P of the pressure buffer, the restoring force of the wave springs 20 causes a movement of the plunger 17 in the opposite direction towards the delivery line 4, whereby the buffer volume 19 is reduced, and viscous material is discharged from the buffer volume 19 into the delivery line 4 to supply the metering pump 3. In this way, the pressure buffer 7 can mitigate pressure fluctuations in the delivery line 7 and thereby contribute to a more constant pressure on the inlet side of the metering pump 3. By using wave springs 20, the pressure buffer 7 has an almost linear pressure-volume behavior. In order to prevent overloading the pressure buffer 7, the variable buffer volume 19 can expand in a pressure range of approximately 2 to 20 bar. If these values are exceeded or fallen below, the movement of the plunger 17 is limited by a mechanical stop.

By providing a variable buffer volume on the one hand, and taking into account the operating state of the metering pump 3 on the other, the method according to the invention makes it possible to regulate the delivery pressure of the supply pump 2 such that a substantially constant supply pressure can be provided on the inlet side of the metering pump 3, regardless of any downtimes of the metering pump 3.

In a variant of the method not shown in the figures, additional information regarding the fill level of the buffer volume 19 can be included in the control. For this purpose, the fill level of the buffer volume 19 can be determined indirectly based upon the length of the portion of the plunger 17 protruding from the housing 13 of the pressure buffer 7. For this purpose, a preferably optical sensor can be provided which detects the position of the plunger 17 and sends a corresponding signal to the control unit 9 for further processing.

The invention claimed is:

1. A method for controlling delivery pressure of a supply pump in a system for delivering and metering a viscous material, wherein the system has a supply pump, a metering pump, and a delivery line which extends between the supply pump and the metering pump, and wherein the supply pump delivers the viscous material from a material store to an inlet of the metering pump through the delivery line using a delivery pressure D, wherein, furthermore, a pressure buffer which is pretensioned to a pretensioning pressure P and has a variable buffer volume is connected upstream of the inlet of the metering pump, wherein the buffer volume can receive viscous material from the delivery line when the delivery pressure in the delivery line in the region of the pressure buffer is higher than the pretensioning pressure P of the pressure buffer, and viscous material can be dispensed into the delivery line from the buffer volume when the delivery pressure in the delivery line in the region of the pressure buffer is lower than the pretensioning pressure P of the pressure buffer, wherein the system additionally has a pressure sensor, connected upstream of the inlet of the metering pump for detecting an actual pressure value in the delivery line, and a control unit, wherein the control unit is connected to the pressure sensor, the supply pump, and the metering pump and receives a signal from one or more of them, wherein the control unit transmits a specification value to the supply pump based on a deviation between a specified target pressure value and the actual pressure value in the delivery line as well as operating state of the metering pump; and wherein, in addition to the signal from the pressure sensor and the signal from the metering pump regarding its operating state, information regarding the fill level in the buffer volume is also included in the control.

2. The method according to claim 1, wherein the specification value transmitted from the control unit to the supply pump is provided with a correction value, depending upon the operating state of the metering pump.

3. The method according to claim 1, wherein the pretensioning pressure P of the pressure buffer is applied by at least one spring designed as a wave spring.

4. The method according to claim 1, wherein the pressure buffer comprises a rolling membrane for hermetically separating the variable buffer volume.

5. The method according to claim 1, wherein the variable buffer volume comprises a volume of 500 to 5,000 $mm^3$.

6. The method according to claim 1, wherein the pressure buffer comprises a plunger which protrudes from a housing of the pressure buffer and via which a fill level of the buffer volume can be determined.

7. The method according to claim 1, wherein the pressure sensor and/or a pressure-safeguarding element is accommodated in a housing of the pressure buffer.

8. The method according to claim 7, wherein a time-dependent viscosity profile of the viscous material is stored in the control unit, and the time-dependent change in the viscosity of the viscous material is taken into account when determining the specification value transmitted to the supply pump.

* * * * *